United States Patent [19]

Brown et al.

[11] 4,355,952

[45] Oct. 26, 1982

[54] COMBUSTION TURBINE VANE ASSEMBLY

[75] Inventors: David L. Brown, Swarthmore; Victor D. Miller, Jr., Parkside, both of Pa.

[73] Assignee: Westinghouse Electric Corp., Pittsburgh, Pa.

[21] Appl. No.: 53,630

[22] Filed: Jun. 29, 1979

[51] Int. Cl.[3] ..... F01D 5/18

[52] U.S. Cl. ..... 415/115; 415/137

[58] Field of Search ..... 415/115, 116, 134, 137, 415/139

[56] References Cited

U.S. PATENT DOCUMENTS

| | | | |
|---|---|---|---|
| 2,863,634 | 12/1958 | Chamberlin et al. | 415/134 |
| 3,295,823 | 1/1967 | Waugh et al. | 415/115 |
| 3,362,681 | 1/1968 | Smuland | 415/134 |
| 3,427,000 | 2/1969 | Scalzo | 415/115 |
| 3,511,577 | 5/1970 | Karstensen | 415/115 |
| 3,529,906 | 9/1970 | McLaurin et al. | 415/116 |
| 3,689,174 | 9/1972 | Rahaim et al. | 415/115 |
| 3,807,891 | 4/1974 | McDow et al. | 415/134 |
| 3,892,497 | 7/1975 | Gunderlock et al. | 415/134 |
| 4,213,296 | 7/1980 | Schwarz | 415/116 |

*Primary Examiner*—Louis J. Casaregola
*Attorney, Agent, or Firm*—E. F. Possessky

[57] ABSTRACT

A combustion turbine vane assembly is shown having a retainer block mounting each individual cooled turbine vane. The retainer block has a pair of axially extending opposed rails for sliding receipt of complementary engaging opposed rails on the outer surface of the vane shroud. The block defines a cooling air aperture therethrough. The inner surface of the block is supported a predetermined distance from the opposed surface of the vane shroud defining a cooling fluid receiving chamber therein. The separated distance permits controlled cooling air leakage into a space between the block and the outer shroud. The radial walls of adjacent outer shrouds have complementary axial grooves machined therein and a seal member is disposed therein to bridge the gap and minimize loss of the cooling air.

5 Claims, 2 Drawing Figures

COMBUSTION TURBINE VANE ASSEMBLY

BACKGROUND OF THE INVENTION

1. Field of the Invention:

This invention relates to assembly of a cooled stator vane within a combustion turbine engine and more particularly to an assembly that permits close tolerances between each vane and its corresponding retainer block to minimize cooling air loss.

2. Description of the Prior Art:

U.S. Pat. No. 3,689,174 of common assignee to the present invention describes a single air-cooled vane and retainer block assembly. As in the assembly of the present invention, the cooling air is introduced into the vane through an opening in the retainer block, however some cooling air leakage into the space between the vane and the retainer block is desirable to maintain sufficient pressure therein to prevent the inflow of the motive gas to these parts. As seen in FIG. 6 of the above patent, the mounting rails of each vane were slidingly engaged in opposed slots on adjacent retainer blocks. This two block support arrangement resulted in unacceptable tolerance buildup and loss of clearance control at assembly, particularly at the junction of adjacent outer shrouds and also at the interface of the inner surface of the retainer block and the opposed surface of the cooling air inlet chamber often resulting in assembly problems and requiring final grinding of adjacent surfaces for the assembly. To accommodate this problem, adjacent vane shrouds were overlapped in a spaced relationship to provide a tortuous flow path for cooling air leakage. However, uniformity in closing the gap, as the shrouds expanded when operating, was not attained and such configuration ultimately permitted unacceptable leakage of cooling air into the motive gas flow path.

SUMMARY OF THE INVENTION

The present invention provides an assembly of one vane mounted on opposed rails of a single retainer block permitting with facing engaging support surfaces to be machined within a minimum tolerance and eliminating a tolerance buildup that heretofore to accommodate the assembly, resulted in unacceptable cooling air loss as it flowed from the block and into an adjacent vane. Further, the assembly provides separate seals received within machined grooves of adjacent outer shroud members to minimize cooling air leakage from between adjacent vanes.

DESCRIPTION OF THE PREFERRED EMBODIMENT

Figure 1:
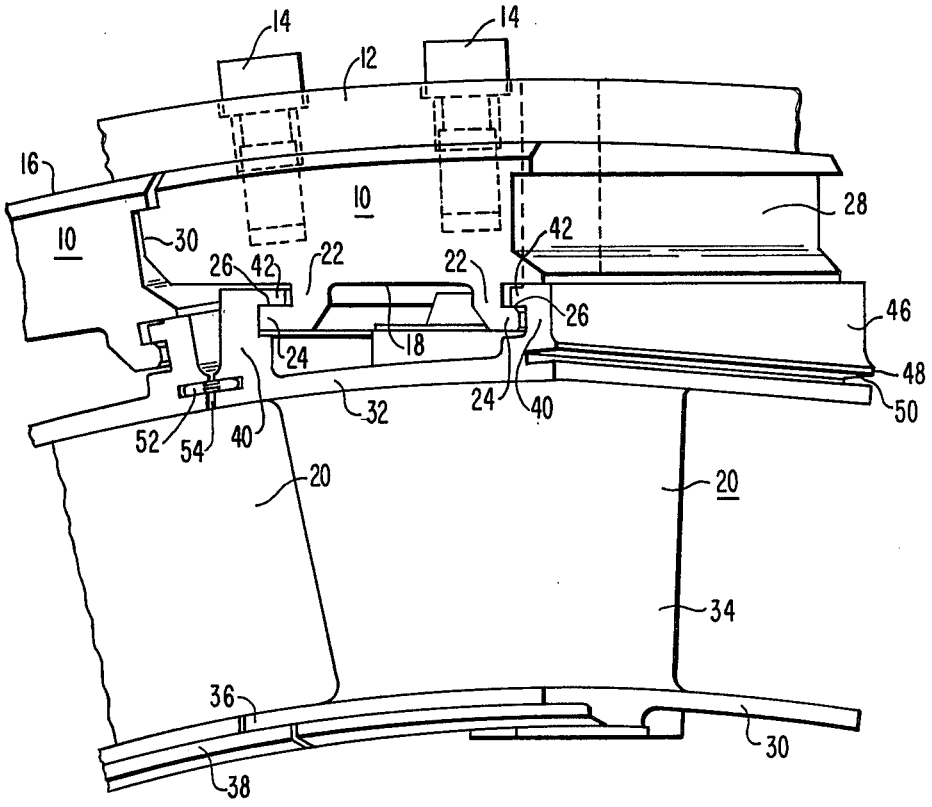
FIG. 1 is a front elevational view of the vane assembly of the present invention.

Previously identified commonly owned U.S. Pat. No. 3,689,174 generally describes the assembly of a retainer block on the blade ring of a combustion turbine engine, and for such description is herein incorporated by reference, in that the retainer block of the instant invention is likewise mounted in the turbine. Thus, referring to FIG. 1 hereof, two adjacent retainer blocks 10 are mounted on the blade ring 12 of the turbine as through bolts 14. The upper surface 16 of each block 10 conforms to the facing abutting surface of the blade ring 12 whereas the radially inner surface 18 of the block is contoured to engage and mount a single vane 20. As is seen, each inner surface defines a pair of radially inwardly extending rail member 22 extending across the axial dimension of the retainer block parallel to the stagger axis with each defining a generally circumferentially-outwardly projecting lip 24 having an upper support surface 26. The opposed rails are separated by a circumferential space to accommodate the structure of the upper surface of the outer shroud as subsequently described. The radially facing side walls 28, 30 of the block are also notched inwardly and outwardly respectively for generally nesting receipt of the complementary surface of each adjacent block.

The cooled vane 20 generally defines an inner shroud 30, an outer shroud 32 and an airfoil portion 34 extending therebetween and forming integral components of a single casting. As it is the assembly between the outer shroud 32 and the block 10 which supports the vane 20, such structure will be described in detail. However, it is sufficient to note that the inner shroud 30 of adjacent vanes also define overlapping shoulders 36, 38 to minimize motive gas leakage into the rotor cavity of the turbine.

The outer shroud 32 defines upwardly extending support rails 40 likewise extending the axial extent of the shroud parallel to the stagger axis and terminating in generally circumferentially converging shoulders 42 defining an inner support surface 44 for facing engagement with the upper support surface 26 of the retainer block 10.

The circumferentially outer generally radial surfaces 46 of the opposed support rails 40 include a radially inner generally planar portion 48 for spaced, opposed facing arrangement with a like portion 48 of the adjacent shroud. Each such portion 48 defines a machined groove 50 open in the circumferential direction and in alignment with the like groove 50 on the adjacent shroud. A sealing strip 52 is inserted in and retained between these opposed grooves to sealingly bridge the circumferential gap 54 between adjacent outer shrouds.

Figure 2:
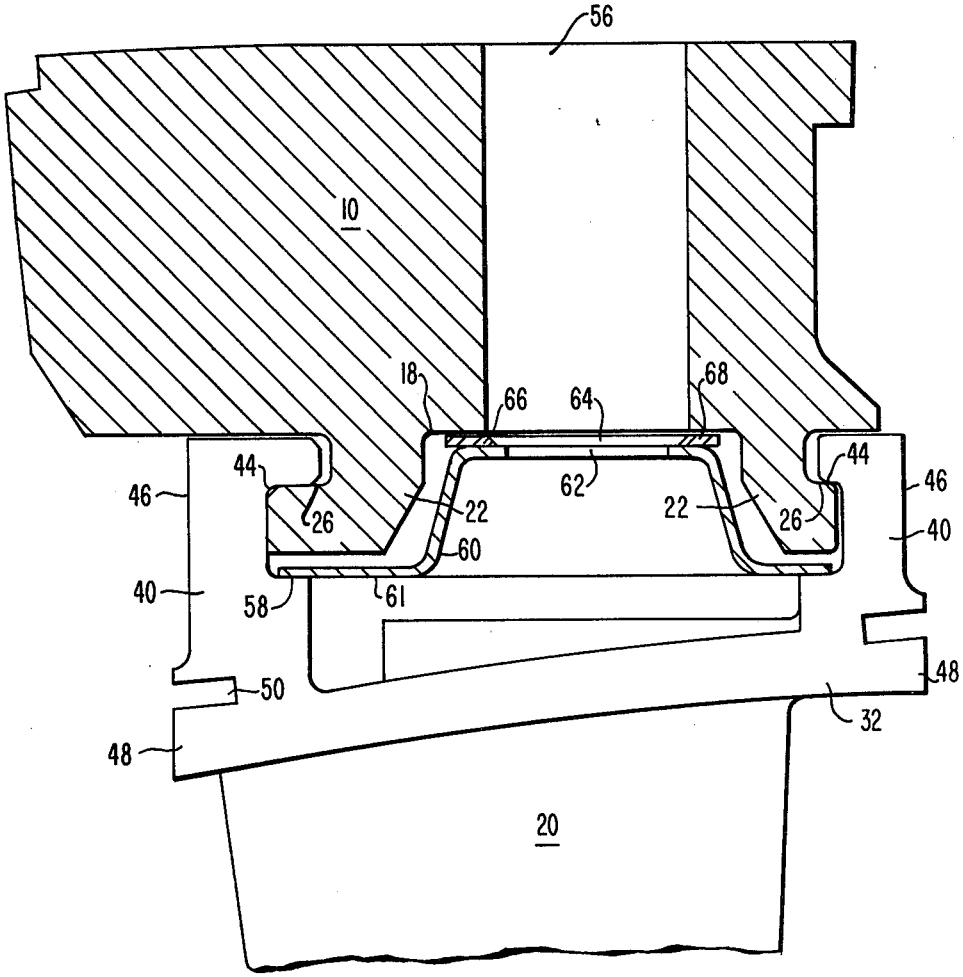
FIG. 2 is an elevational view of the block and outer shroud assembly of the present invention in the direction of the stagger axis of the assembly.

Referring now to FIG. 2, it is seen that the retaining block 10 includes an aperture 56 therethrough for directing cooling air to the inner surface 18 of the block between the inwardly extending rail members 22. The upper surface of the outer shroud has an outer peripheral sealing surface 58 (generally in the configuration of an oval and corresponding to the raised surface shown in the previously identified patent to enclose the cavity opening into the airfoil portion) supporting in sealed relationship a flanged cover member 60 having, in cross-section, a generally inverted U-shape with the flanges 61 brazed to surface 58. The cover member 60 has an opening 62 generally in alignment with aperture 56, when assembled, and a generally planar spacer member 66 is brazed to the upper surface of the cover 60 surrounding the opening 62 and also defining an aligned opening 64. The upper surface 68 of the spacer member 66 is substantially planar as is the opposed facing inner surface 18 of the retainer block and can be, by close tolerance machining, maintained at a predetermined dimension with respect to the support surface 44 to establish a predetermined spatial separation between the opposed surfaces 18, 68 to closely control cooling air leakage at this interface.

Thus, with such mounting of a single vane 20 on a single retainer block 10, it is permissible to machine the supporting engaging surfaces 26, 44 between the respective support rails to within a minimum tolerance and machine the opposed facing surfaces 18, 68 of the retainer block 10 and spacer 66 respectively also to within a minimum tolerance to permit sliding assembly of the outer shroud 32 onto the retainer block 10 and maintain a controlled clearance between the surfaces 18 and 68 to control cooling air leakage at the juncture of these two surfaces, and thereby maintain the space defined between the vane 20 and its supporting retainer block 10 under a pressure (i.e the pressure of the cooling air) sufficient to protect this area from the inflow of the motive gas. Further, the sealing strip 52 between adjacent facing vane shrouds 32 minimizes leakage of this cooling air from such cavity with the ultimate result being a controlled tolerance assembly that minimizes cooling air loss.

What we claim is:

1. A cooled vane and vane support assembly for a combustion turbine engine comprising:

an individual vane mounting block having inwardly projecting opposed spaced support means for generally axial sliding receipt of the vane and having an inwardly facing sealing surface defining an outlet from a cooling air aperture therethrough disposed between said spaced support means;

a vane having an outer shroud defining generally radially outwardly projecting opposed spaced support means each having an inwardly facing support surface in complementary engagement with an outwardly facing support surface of said support means on said mounting block;

a cooling air receiving chamber disposed between said opposed spaced vane support means and forming a part of said outer shroud and having an outwardly facing sealing surface defining entry to an opening therein generally coterminous with the aperture through said mounting block to provide for coolant air flow into said vane shroud;

means for directing leakage coolant air flow from said block aperture between said block and shroud sealing surfaces to said block and shroud support surfaces; and said block and shroud support surfaces being related to each other such that a spacing with accurately predetermined tolerance exists between said block and shroud sealing surfaces to permit said leakage coolant flow in an amount which is sufficient to maintain pressure against turbine motive gas inflow without resulting in excessive coolant air loss.

2. Structure according to claim 1 wherein said outer shroud also includes a generally radially extending outer portion in opposed facing spaced relationship with a like portion of the outer shroud of an adjacent vane and open facing groove means in said respective portions of adjacent shrouds and a seal strip disposed and retained in said facing grooves to generally seal the separation between adjacent outer shrouds and restrict the flow of cooling air into the gas flow path of the combustion turbine engine.

3. Structure according to claim 2 wherein the upper surface of said air receiving chamber includes a planar surface surrounding said opening and wherein said planar surface is maintained, by said minimum tolerance machining, a predetermined distance from the opposed face of said mounting block within minimum tolerance variations.

4. A cooled vane assembly for a combustion turbine engine comprising a vane mounting block for mounting on said engine and having inwardly projecting opposed spaced vane support members terminating in generally circumferentially projecting first rails, said block defining a cooling air aperture terminating at and defined by an inner sealing surface located between said spaced vane support members;

a vane having an outer shroud defining generally radially outwardly projecting opposed spaced support means terminating in circumferentially projecting second rails for complementary support engagement with said first rails;

said outer shroud and having an outermost generally planar sealing surface defining an opening thereinto generally coterminous with the aperture through said block for coolant air flow into said shroud, the engaging surfaces of said first and second rails being machined to a predetermined minimum tolerance to establish a permitted spatial separation between said sealing surface defining said chamber opening and the opposed sealing surface of said block to control the amount of cooling air escaping through said separation;

means for directing leakage coolant air flow from said block aperature between said block and shroud sealing surfaces to said block and shroud surfaces; and seal means between opposed facing shoulders of adjacent outer shrouds to minimize the leakage of said cooling air into the motive gas path of said turbine.

5. Structure according to claim 4 wherein the upper surface of said air receiving chamber is machined to a predetermined dimension above said machined surface of said second rails to establish said controlled separation thereof from the opposed face of said block in the assembled position.

* * * * *